US011627778B2

(12) United States Patent
Hurd et al.

(10) Patent No.: US 11,627,778 B2
(45) Date of Patent: Apr. 18, 2023

(54) CUSHIONING MEMBER FOR ARTICLE OF FOOTWEAR

(71) Applicant: NIKE, Inc., Beaverton, OR (US)

(72) Inventors: John Hurd, Lake Oswego, OR (US); Joel R. Greenspan, Portland, OR (US); Cassidy R. Levy, West Linn, OR (US); Nicholas R. Long, Portland, OR (US); Tetsuya T. Minami, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 81 days.

(21) Appl. No.: 16/493,952

(22) PCT Filed: Mar. 16, 2017

(86) PCT No.: PCT/US2017/022651
§ 371 (c)(1),
(2) Date: Sep. 13, 2019

(87) PCT Pub. No.: WO2018/169537
PCT Pub. Date: Sep. 20, 2018

(65) Prior Publication Data
US 2020/0077741 A1 Mar. 12, 2020

(51) Int. Cl.
*A43B 13/18* (2006.01)
*A43B 13/12* (2006.01)
*A43B 13/04* (2006.01)

(52) U.S. Cl.
CPC ..... *A43B 13/187* (2013.01); *A43B 13/04* (2013.01); *A43B 13/125* (2013.01); *A43B 13/186* (2013.01)

(58) Field of Classification Search
CPC ... A43B 13/187; A43B 13/127; A43B 13/125; A43B 13/188; A43B 13/186; A43B 13/04
See application file for complete search history.

(56) References Cited

U.S. PATENT DOCUMENTS 3,724,106 A * 4/1973 Magidson ..... A43B 17/03 36/44
3,906,570 A 9/1975 Revill
(Continued)

FOREIGN PATENT DOCUMENTS

CH 283034 A 5/1952
CN 1053884 A 8/1991
(Continued)

OTHER PUBLICATIONS

European Patent Office, Extended European Search Report for EP Application No. 19196682.9, dated Jan. 2, 2020.
(Continued)

*Primary Examiner* — Khoa D Huynh
*Assistant Examiner* — Haley A Smith
(74) *Attorney, Agent, or Firm* — Honigman LLP; Matthew H. Szalach; Jonathan P. O'Brien

(57) ABSTRACT

A cushioning member for an article of footwear is provided and includes a first barrier member defining a first compartment and a second compartment and being formed from a first material. A second barrier member is attached to the first barrier member, covers the first compartment to define a first interior void, and covers the second compartment to define a second interior void. The second barrier is formed from a second material different than the first material. The cushioning member also includes a first quantity of particulate matter disposed within the first interior void and a second quantity of particulate matter disposed within the second interior void.

16 Claims, 12 Drawing Sheets

(56) References Cited

U.S. PATENT DOCUMENTS

| | | | | |
|---|---|---|---|---|
| 4,658,515 | A * | 4/1987 | Oatman | A43B 17/14 36/2.6 |
| 5,718,063 | A * | 2/1998 | Yamashita | A43B 1/0072 36/28 |
| 5,718,064 | A | 2/1998 | Pyle | |
| 5,890,248 | A * | 4/1999 | Gee | B29D 35/10 12/146 B |
| 5,920,915 | A | 7/1999 | Bainbridge et al. | |
| 6,032,300 | A | 3/2000 | Bainbridge et al. | |
| 8,713,817 | B2 * | 5/2014 | Litchfield | A43B 13/12 36/35 B |
| 9,125,454 | B2 * | 9/2015 | De Roode | A43B 13/20 |
| 9,737,111 | B2 * | 8/2017 | Lustik | A43B 7/1435 |
| 2001/0042321 | A1 * | 11/2001 | Tawney | A43B 13/20 36/43 |
| 2003/0046831 | A1 * | 3/2003 | Westin | A43B 13/187 36/43 |
| 2003/0217484 | A1 * | 11/2003 | Christensen | A43B 13/203 36/29 |
| 2005/0086728 | A1 | 4/2005 | Tobergte | |
| 2005/0150132 | A1 * | 7/2005 | Iannacone | A43B 3/105 36/11.5 |
| 2006/0010717 | A1 * | 1/2006 | Finkelstein | A43B 13/187 36/43 |
| 2006/0026863 | A1 | 2/2006 | Liu | |
| 2006/0130363 | A1 * | 6/2006 | Hottinger | A43B 13/125 36/11.5 |
| 2006/0206977 | A1 | 9/2006 | Hammons et al. | |
| 2007/0051018 | A1 * | 3/2007 | Issler | A43B 9/02 36/29 |
| 2007/0169379 | A1 | 7/2007 | Hazenberg et al. | |
| 2009/0188129 | A1 * | 7/2009 | Fusco | A43B 7/142 36/44 |
| 2010/0154252 | A1 * | 6/2010 | Avent | A61F 5/14 36/35 R |
| 2010/0251565 | A1 * | 10/2010 | Litchfield | A43B 13/189 36/35 B |
| 2013/0247422 | A1 * | 9/2013 | Holt | A43B 9/04 36/83 |
| 2014/0151918 | A1 | 6/2014 | Hartmann | |
| 2014/0259754 | A1 * | 9/2014 | Lustik | A43B 7/1445 36/43 |
| 2014/0283413 | A1 * | 9/2014 | Christensen | A43B 13/16 36/102 |
| 2015/0223564 | A1 * | 8/2015 | Peyton | A43B 13/184 36/28 |
| 2015/0257481 | A1 * | 9/2015 | Campos, II | A43B 13/189 36/103 |
| 2015/0264999 | A1 | 9/2015 | Marshall et al. | |
| 2016/0010717 | A1 | 1/2016 | Tosovsky | |
| 2016/0073732 | A1 | 3/2016 | Ernst et al. | |
| 2016/0157554 | A1 | 6/2016 | Adams | |
| 2016/0278481 | A1 | 9/2016 | Le et al. | |
| 2017/0055636 | A1 | 3/2017 | Campos, II et al. | |
| 2018/0077997 | A1 * | 3/2018 | Hoffer | A43B 13/188 |
| 2018/0132564 | A1 | 5/2018 | Bruce et al. | |
| 2018/0228248 | A1 * | 8/2018 | Hazenberg | B29C 65/02 |
| 2018/0352900 | A1 | 12/2018 | Hartmann et al. | |
| 2019/0343225 | A1 | 11/2019 | Reddy et al. | |
| 2019/0380424 | A1 | 12/2019 | Tamm et al. | |

FOREIGN PATENT DOCUMENTS

| | | | |
|---|---|---|---|
| CN | 1211901 | A | 3/1999 |
| CN | 2620493 | Y | 6/2004 |
| CN | 2888936 | Y | 4/2007 |
| CN | 202051034 | U | 11/2011 |
| CN | 202145956 | U | 2/2012 |
| CN | 102481031 | A | 5/2012 |
| CN | 103141993 | A | 6/2013 |
| CN | 103720129 | A | 4/2014 |
| CN | 103747700 | A | 4/2014 |
| CN | 104010541 | A | 8/2014 |
| CN | 104203029 | A | 12/2014 |
| CN | 104363783 | A | 2/2015 |
| CN | 104490008 | A | 4/2015 |
| CN | 109952042 | A | 6/2019 |
| DE | 19938609 | A1 | 3/2001 |
| DE | 102010046278 | A1 | 2/2011 |
| DE | 202016104626 | U1 | 10/2016 |
| EP | 0007948 | A1 | 2/1980 |
| EP | 2609824 | A1 | 7/2013 |
| EP | 2649896 | B1 | 10/2016 |
| EP | 3386334 | A1 | 10/2018 |
| FR | 2642941 | A1 | 8/1990 |
| GB | 1301147 | A | 12/1972 |
| JP | H02252401 | A | 10/1990 |
| JP | 2008533327 | A | 8/2008 |
| JP | 2009056007 | A | 3/2009 |
| JP | 2016182332 | A | 10/2016 |
| KR | 20100086227 | A | 7/2010 |
| KR | 20120033710 | A | 4/2012 |
| WO | WO-2012177957 | A2 | 12/2012 |
| WO | WO-2013013784 | A1 | 1/2013 |
| WO | WO-2014126799 | A1 | 8/2014 |
| WO | WO-2015/065578 | A1 | 5/2015 |
| WO | WO-2018169535 | A1 | 9/2018 |
| WO | WO-2018175734 | A1 | 9/2018 |
| WO | WO-2020125963 | A1 | 6/2020 |

OTHER PUBLICATIONS

China National Intellectual Property Office, Office Action for CN Application No. 201680062271.7, dated Feb. 3, 2020.

European Patent Office, Communication pursuant to Article 94(3) EPC for EP Application No. 16777863.8, dated Apr. 15, 2020.

Japan Patent Office, Decision of Rejection for JP Application No. 2018-515812, dated Apr. 6, 2020.

European Patent Office, Extended European Search Report for EP Application No. 19212921.1, dated Mar. 31, 2020.

European Patent Office, Communication pursuant to Article 94(3) EPC for EP Application No. 16777865.3, dated Apr. 20, 2020.

Korean Intellectual Property Office, Office Action for KR Application No. 10-2020-7003423, dated Apr. 21, 2020.

European Patent Office (ISA), International Search Report and Written Opinion for PCT Application No. PCT/US2017/022651, dated Oct. 25, 2017.

European Patent Office (ISA), International Search Report and Written Opinion for PCT Application No. PCT/US2017/022647, dated Nov. 2, 2017.

Korean Intellectual Property Office, Office Action for KR Application No. 10-2019-7036063, dated Feb. 7, 2020.

China National Intellectual Property Office, Office Action for CN Application No. 201680066156.7, dated Jan. 22, 2020.

China National Intellectual Property Office, Office Action and Search Report for CN Application No. 201680062323.0, dated Mar. 4, 2020.

China National Intellectual Property Office, Office Action and Search Report for CN Application No. 201680062231.2, dated Mar. 24, 2020.

China National Intellectual Property Office, Office Action for CN Application No. 201680066534.1, dated Mar. 26, 2020.

China National Intellectual Property Office, Office Action and Search Report for CN Application No. 201680062300.X, dated Mar. 12, 2020.

European Patent Office, Communication pursuant to Article 94(3) EPC for EP Application No. 16777864.6, dated Apr. 7, 2020.

European Patent Office (ISA), International Search Report and Written Opinion for PCT Application No. PCT/US2020/042784, dated Sep. 17, 2020.

Ge, Chengbiao et al., Steam-chest molding of expanded thermoplastic polyuerethane bead foams and their mechanical properties, Chemical Engineering Science 174 (2017) pp. 337-346.

Japan Patent Office, Notification of Reasons for Refusal for JP Application No. 2019-550843, dated Nov. 24, 2020.

European Patent Office, Communication pursuant to Article 94(3) EPC for EP Application No. 16777864.6, dated Dec. 16, 2020.

(56) References Cited

OTHER PUBLICATIONS

European Patent Office, Communication pursuant to Article 94(3) EPC for EP Application No. 16777863.8, dated Dec. 22, 2020.
KS65 Luxury Light Fescue—Field Green <http://www.kodiaksports.com/Artificial-Turf/Fake-Grass/Artificial-Grass-ST65_LFS_Field, Oct. 12, 2013, (Oct. 12, 2013), Retrieved from Internet: URL:https://web.archive.org/web/*/http://www.kodiaksports.com/core/media/media.nl/id.28351/c.1268496/.f?h=1c04c87e9fd3f9d67f24 [retrieved on Dec. 15, 2016].
European Patent Office as the International Searching Authority, International Search Report and Written Opinion for PCT Application No. PCT/US2020/042735, dated Sep. 16, 2020.
European Patent Office as the International Searching Authority, International Search Report and Written Opinion for PCT Application No. PCT/US2020/042784, dated Sep. 17, 2020.
European Patent Office as the International Searching Authority, International Search Report and Written Opinion for PCT Application No. PCT/US2020/042807, dated Sep. 16, 2020.
Japan Patent Office, Notice of Reasons for Rejection for JP Application No. 2019-550853 dated May 25, 2021.
Japanese Office Action for Application No. 2020-017000 dated May 31, 2021.
China National Intellectual Property Administration, Second Office Action for application No. 201780088457.4 dated Jul. 19, 2021.
Taiwan Intellectual Property Office, Office Action dated Sep. 3, 2021 for application No. 109125077.
Taiwan Intellectual Property Office, Office Action dated Jun. 3, 2021 for application No. 109125078.
Taiwan Intellectual Property Office, Office Action dated Jun. 3, 2021 for application No. 109125079.
China National Intellectual Property Administration, Decision of Rejection Office Action dated Jun. 29, 2021 for application No. 201680062323.0.
China National Intellectual Property Office, Office Action for Application No. 201980047915.9 dated Jul. 30, 2021.
European Patent Office, Extended European Search Report for EP Application No. 22161547.9 dated Jun. 3, 2022.
USPTO, Non-Final Office Action for U.S. Appl. No. 16/493,994, dated Oct. 6, 2022.

* cited by examiner

CUSHIONING MEMBER FOR ARTICLE OF FOOTWEAR

CROSS REFERENCE TO RELATED APPLICATION

This application is a 371 National Stage entry based on International Application No. PCT/US2017/022651, filed Mar. 16, 2017, the disclosure of which is hereby incorporated by reference in its entirety.

FIELD

The present disclosure relates to cushioning members incorporating particulate matter and more particularly to cushioning members incorporating particulate matter for use with articles of footwear

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and is generally at least partially formed from a polymer foam material that compresses resiliently under an applied load to cushion the foot by attenuating ground-reaction forces. The midsole may define a bottom surface on one side that opposes the outsole and a footbed on the opposite side that may be contoured to conform to a profile of the bottom surface of the foot. Sole structures may also include a comfort-enhancing insole or a sockliner located within a void proximate to the bottom portion of the upper.

Midsoles using polymer foam materials are generally configured as a single slab that compresses resiliently under applied loads, such as during walking or running movements. Generally, single-slab polymer foams are designed with an emphasis on balancing cushioning characteristics that relate to softness and responsiveness as the slab compresses under gradient loads. Polymer foams providing cushioning that is too soft will decrease the compressibility and the ability of the midsole to attenuate ground-reaction forces after repeated compressions. Conversely, polymer foams that are too hard and, thus, very responsive, sacrifice softness, thereby resulting in a loss in comfort. While different regions of a slab of polymer foam may vary in density, hardness, energy return, and material selection to balance the softness and responsiveness of the slab as a whole, creating a single slab of polymer foam that loads in a gradient manner from soft to responsive is difficult to achieve.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
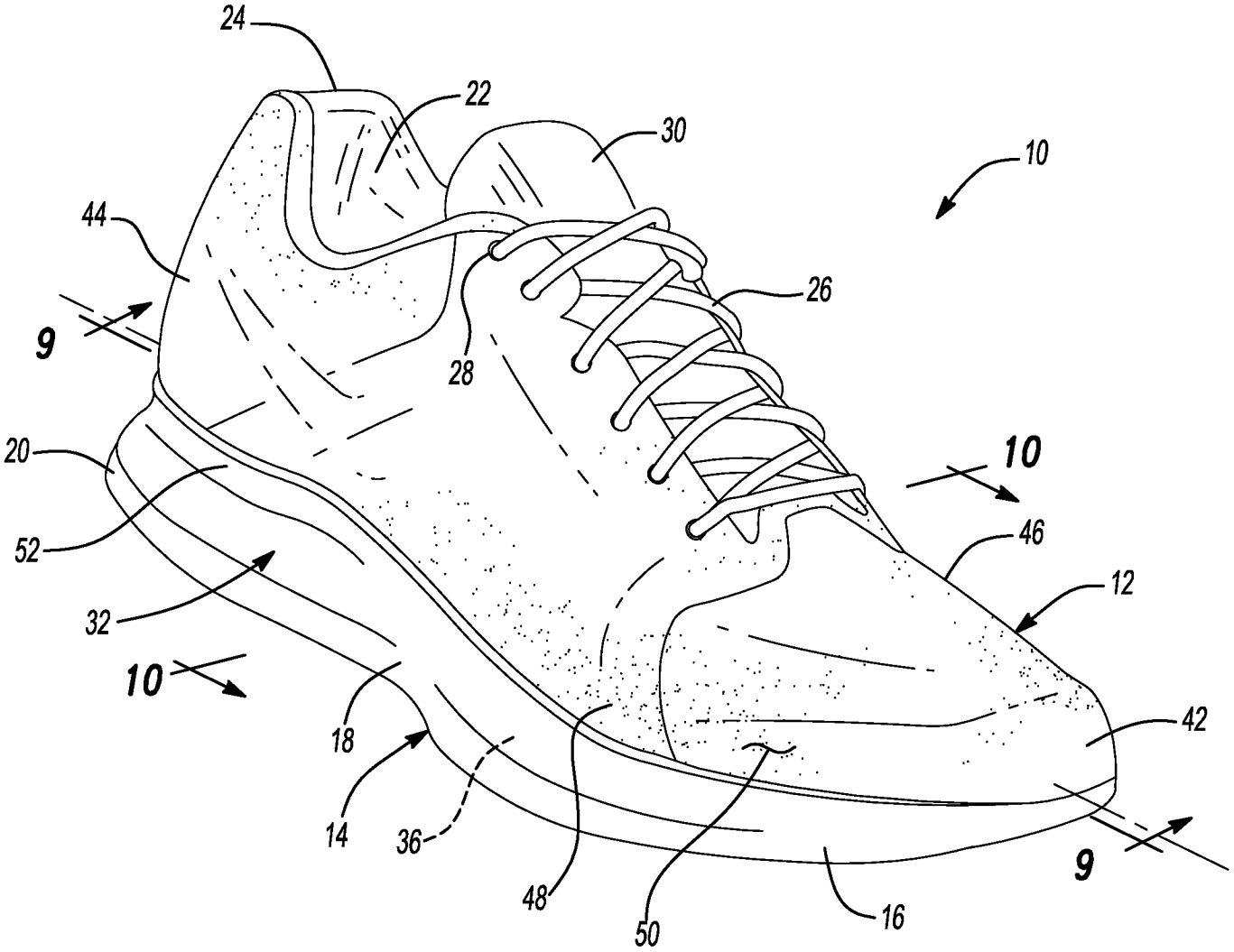
FIG. 1 is a perspective view of an article of footwear in accordance with the principals of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a cushioning member for an article of footwear. The cushioning member includes a first barrier member defining a first compartment and a second compartment and being formed from a first material. A second barrier member is attached to the first barrier member, covers the first compartment to define a first interior void, and covers the second compartment to define a second interior void. The second barrier is formed from a second material different than the first material. The cushioning member also includes a first quantity of particulate matter disposed within the first interior void and a second quantity of particulate matter disposed within the second interior void.

Implementations of the disclosure may include one or more of the following optional features. In some implementations, the first material is a polymer. For example, the first material may be thermoplastic polyurethane (TPU). In some examples, the second material is spandex. One of the first material and the second material may be permeable and the other of the first material and the second material may be impermeable. Additionally or alternatively, the first material may be impermeable and the second material may be permeable.

In some examples, the first quantity of particulate matter and the second quantity of particulate matter are approximately the same. Alternatively, the first quantity of particulate matter and the second quantity of particulate matter may be different. At least one of the first quantity of particulate matter and the second quantity of particulate matter may include foam beads. The foam beads may include a substantially spherical shape. Further, the foam beads may include approximately the same size and shape. In some examples, the foam beads may include at least one of a different size and shape.

In some implementations, the cushioning member includes an adhesive disposed between the first barrier member and the second barrier member. The adhesive may surround the first compartment and the second compartment. The adhesive may be a hot melt adhesive. The first compartment and the second compartment may taper in a direction away from the second barrier member.

Another aspect of the disclosure provides a sole structure for an article of footwear. The sole structure includes a midsole defining a first cavity and a second cavity, and a cushioning member including a first compartment received by the first cavity and containing a first quantity of particulate matter and a second compartment received by the second cavity and containing a second quantity of particulate matter. The cushioning member includes a first barrier member and a second barrier member that cooperate to contain the first quantity of particulate matter within the first compartment and cooperate to contain the second quantity of particulate matter within the second compartment.

This aspect may include one or more of the following optional features. In some implementations, the first barrier member defines the first compartment and the second compartment and the second barrier is attached to the first barrier member. An adhesive may be disposed between the first barrier member and the second barrier member. The adhesive may surround the first compartment and the second compartment. In some examples, the adhesive is a hot melt adhesive. The first compartment and the second compartment may taper in a direction away from the second barrier member.

In some examples, the second barrier member covers the first compartment to define a first interior void and covers the second compartment to define a second interior void. The first quantity of particulate matter may be disposed within the first interior void and the second quantity of particulate matter may be disposed within the second interior void. The first barrier member may be formed from a first material and the second barrier member may be formed from a second material different than the first material.

The first material may be a polymer. For example, the first material may be thermoplastic polyurethane (TPU). The second material may be spandex. One of the first material and the second material may be permeable and the other of the first material and the second material may be impermeable. In some examples, the first material is impermeable and the second material is permeable.

In some implementations, the first quantity of particulate matter and the second quantity of particulate matter are approximately the same. Alternatively, the first quantity of particulate matter and the second quantity of particulate matter may be different. At least one of the first quantity of particulate matter and the second quantity of particulate matter may include foam beads. The foam beads may include a substantially spherical shape. The foam beads may include approximately the same size and shape. In some examples, the foam beads include at least one of a different size and shape The midsole may extend between the first compartment and the second compartment. The cushioning member may include a web portion extending between and connecting the first compartment and the second compartment. The midsole may be attached to the cushioning member at the web portion. Alternatively, the midsole may be spaced apart from the cushioning member at the web portion.

Yet another aspect of the disclosure provides a sole structure for an article of footwear. The sole structure includes an outsole, a midsole including a first cavity, and a cushioning member. A first aperture is formed in a first surface of the midsole and is in fluid communication with the first cavity. A second aperture is formed in a second surface of the midsole and is in fluid communication with the first cavity. The second surface is disposed on an opposite side of the midsole than the first surface and opposes the outsole. The cushioning member includes a first compartment that is received by the first cavity and contains a first quantity of particulate matter. The particulate matter is visible through the second aperture at the outsole.

This aspect may include one or more of the following optional features. In some implementations, the cushioning member includes a first barrier member and a second barrier member that cooperate to contain the first quantity of particulate matter within the first compartment. The first barrier member may define the first compartment and the second barrier member may be attached to the first barrier member. An adhesive may be disposed between the first barrier member and the second barrier member. The adhesive may surround the first compartment and may be a hot melt adhesive. The first compartment may taper in a direction away from the second barrier member.

In some examples, the second barrier member covers the first compartment to define a first interior void. The first quantity of particulate matter may be disposed within the first interior void. The first barrier member may be formed from a first material and the second barrier member may be formed from a second material different than the first material.

In some implementations, the first material is a polymer. For example, the first material may be thermoplastic polyurethane (TPU). The second material may be spandex. One of the first material and the second material may be permeable, and the other of the first material and the second material may be impermeable. In some examples, the first material is impermeable and the second material is permeable.

The first quantity of particulate matter may include foam beads. The foam beads may include a substantially spherical shape. Further, the foam beads may include approximately the same size and shape. Alternatively, the foam beads may include at least one of a different size and shape.

In some examples, the outsole is formed from one of a transparent material and a translucent material. The first quantity of particulate matter may be visible at the second aperture through the material of the outsole. The midsole may include a second cavity, a third aperture formed in the first surface of the midsole and in fluid communication with the second cavity, and a fourth aperture formed in the second surface of the midsole and in fluid communication with the second cavity.

The cushioning member may include a second compartment received by the second cavity of the midsole and containing a second quantity of particulate matter. The second quantity of particulate matter may be visible through the fourth aperture at the outsole. An outer surface of the cushioning member may be substantially flush with the first surface of the midsole. The outer surface of the cushioning member may protrude from the first surface of the midsole to define at least one bulge. The at least one bulge may be formed at the first compartment.

Figure 2:
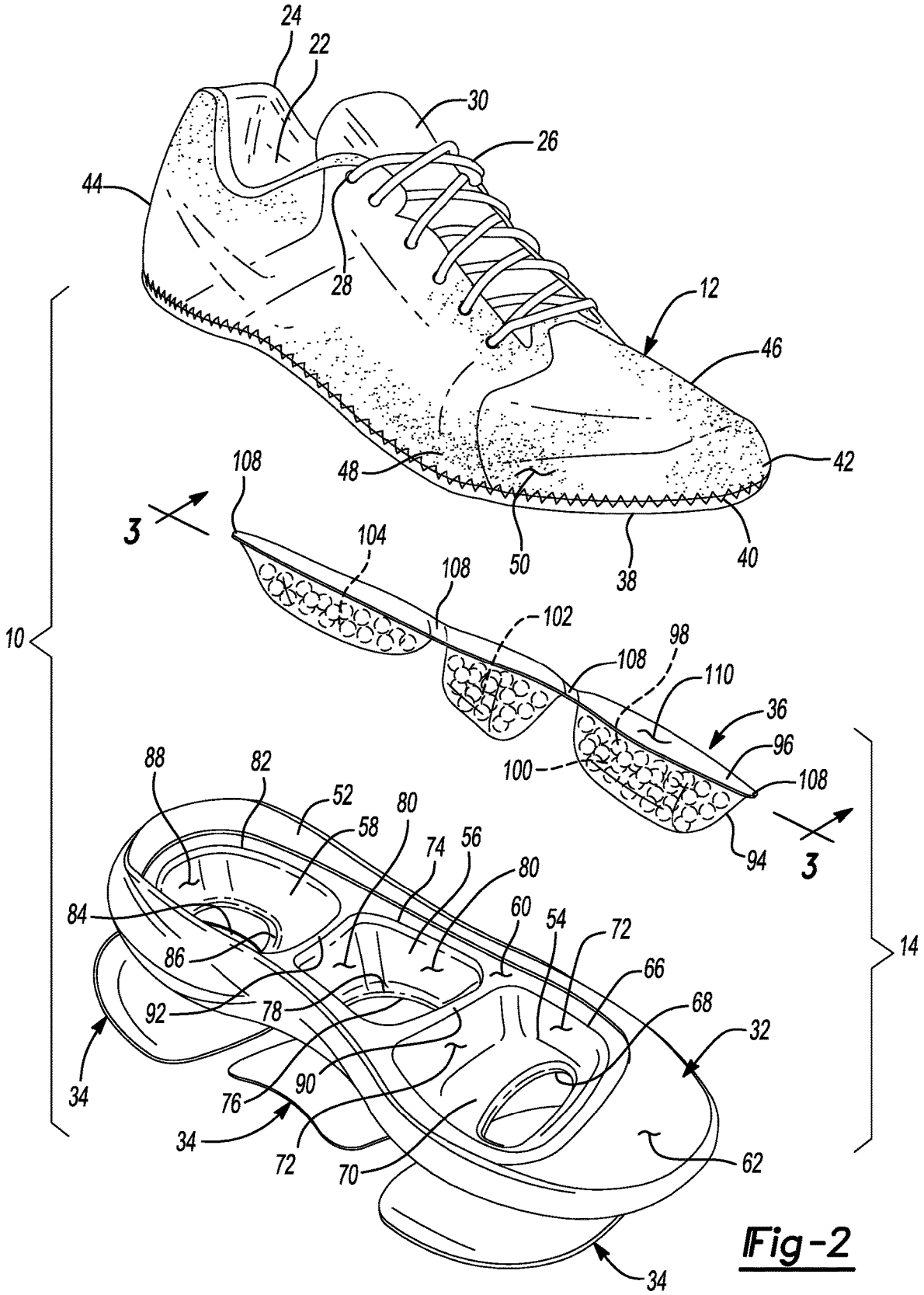
FIG. 2 is an exploded view of the article of footwear of FIG. 2.

With reference to FIGS. 1 and 2, an article of footwear 10 is provided. As shown in FIG. 1, the article of footwear 10 includes an upper 12 and a sole structure 14 attached to the upper 12. The article of footwear 10 may be divided into one or more portions. The portions may include a forefoot portion 16, a midfoot portion 18, and a heel portion 20. The forefoot portion 16 may correspond with toes and joints connecting metatarsal bones with phalanx bones of a foot. The midfoot portion 18 may correspond with an arch area of the foot, and the heel portion 20 may correspond with rear portions of the foot, including a calcaneus bone.

The upper 12 includes interior surfaces that define an interior void 22 that receives and secures a foot for support on the sole structure 14. An ankle opening 24 located in the heel portion 20 may provide access to the interior void 22. For example, the ankle opening 24 may receive a foot to secure the foot within the void 22 and facilitate entry and removal of the foot from and to the interior void 22. In some examples, one or more fasteners 26 extend along the upper 12 to adjust a fit of the interior void 22 around the foot while concurrently accommodating entry and removal of the foot therefrom. The upper 12 may include apertures 28 such as eyelets and/or other engagement features such as fabric or mesh loops that receive the fasteners 26. The fasteners 26 may include laces, straps, cords, hook-and-loop, or any other suitable type of fastener.

The upper 12 may additionally include a tongue portion 30 that extends between the interior void 22 and the fasteners 26. The upper 12 may be formed from one or more materials that are stitched or adhesively bonded together to form the interior void 22. Suitable materials for the upper may include, but are not limited to, textiles, foam, leather, and synthetic leather. The materials may be selected and located to impart properties of durability, air-permeability, wear-resistance, flexibility, and comfort to the foot while disposed within the interior void 22.

Figure 8:
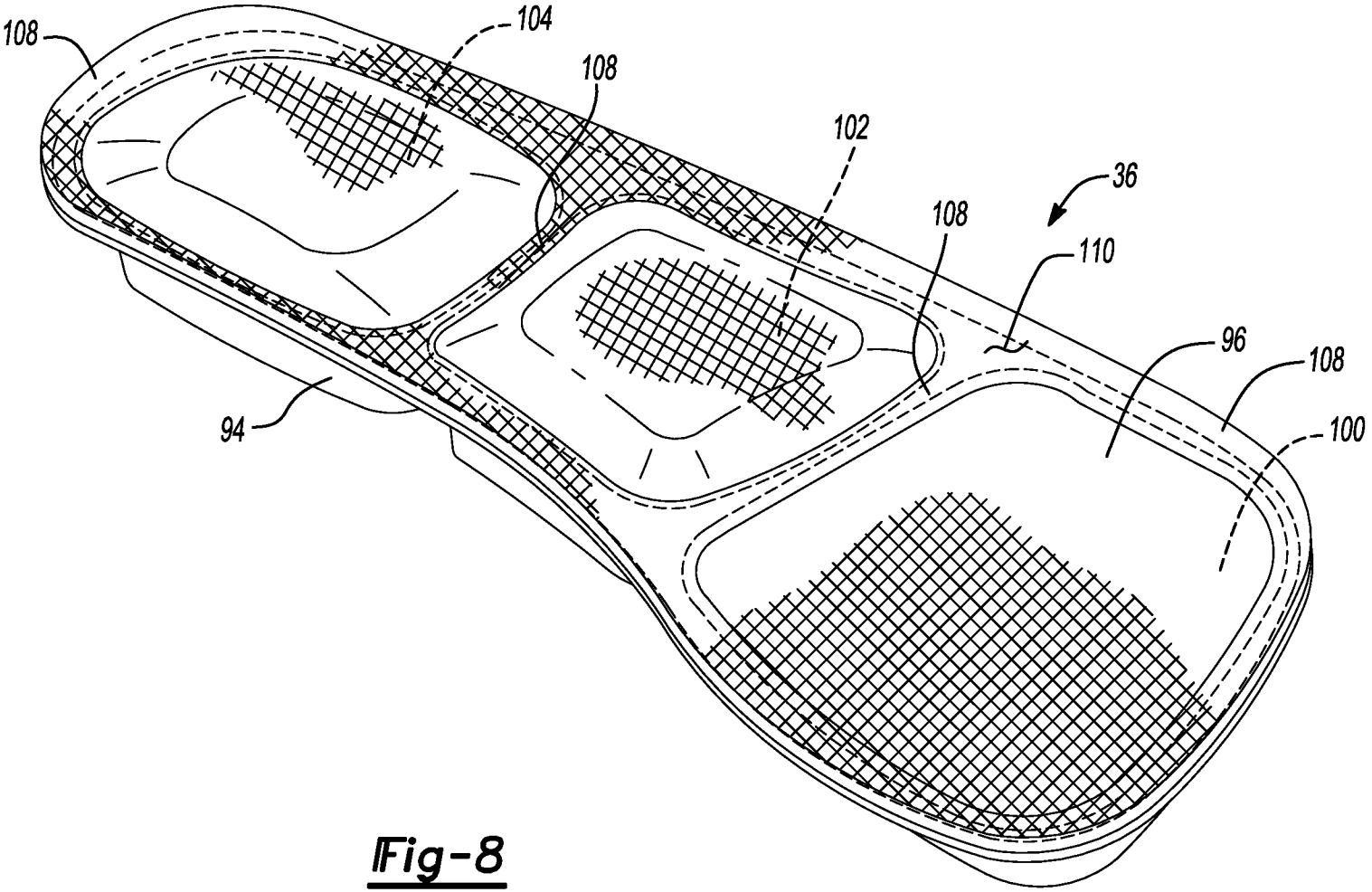
FIG. 8 is a perspective view of a cushioning member of the article of footwear of FIG. 1.

With continued reference to FIGS. 1 and 2, the sole structure 14 is shown as including a midsole 32, an outsole 34, and a cushioning member 36. As shown in FIGS. 2 and 8, the midsole 32 is generally disposed between the outsole 34 and the upper 12 and supports the cushioning member 36 relative to the upper 12. Namely, the midsole 32 may support the cushioning member 36 between the outsole 34 and a lower substrate 38 of the upper 12. The substrate 38 may be attached to the upper 12 via stitching 40 (FIG. 2) or, alternatively, may be integrally formed with a material of the upper 12. For example, if the upper 12 or a portion of the upper 12 is formed from a knit material, the knit material may likewise form the substrate 38 and, as such, the substrate 38 that opposes the midsole 32 and the cushioning member 36 may be integrally formed with the upper 12.

If the substrate 38 is separately formed from the upper 12, the substrate 38 may be attached to the upper 12 via stitching 40. Regardless of whether the substrate 38 is integrally formed with the upper 12 or, alternatively, is a separate component that is attached to the upper 12, the substrate 38 is disposed generally between the midsole 32 and the upper 12 and is formed from a flexible material. Forming the substrate 38 from a flexible material allows the substrate 38 to stretch and move when loaded by a user's foot during use. Allowing the substrate 38 to flex and move in response to a load received by a user's foot during use allows the user's foot to depress the midsole 32 and/or the cushioning member 36, thereby providing the user with a degree of comfort and cushioning during use of the article of footwear 10, as will be described in greater detail below.

The midsole 32 may be formed from a polymer material such as, for example, a foamed polymer material. Namely, the foamed polymer material may be ethyl-vinyl-acetate or polyurethane. Regardless of the particular construction of the midsole 32, the midsole 32 extends generally from an anterior end 42 of the upper 12 to a posterior end 44 of the upper 12. Further, the midsole 32 may extend between a medial side 46 of the upper 12 and a lateral side 48 of the upper 12. In so doing, a portion of the midsole 32 may extend onto an outer surface 50 of the upper 12 proximate to a junction of the upper 12 and the midsole 32. For example, the midsole 32 may include a projection 52 that extends at least partially around a perimeter of the midsole 32 and extends from the midsole 32 to cover a portion of the outer surface 50 of the upper 12. The projection 52 may be integrally formed with the midsole 32 when the material of the midsole is formed into the shape shown in FIG. 2.

Figure 9:
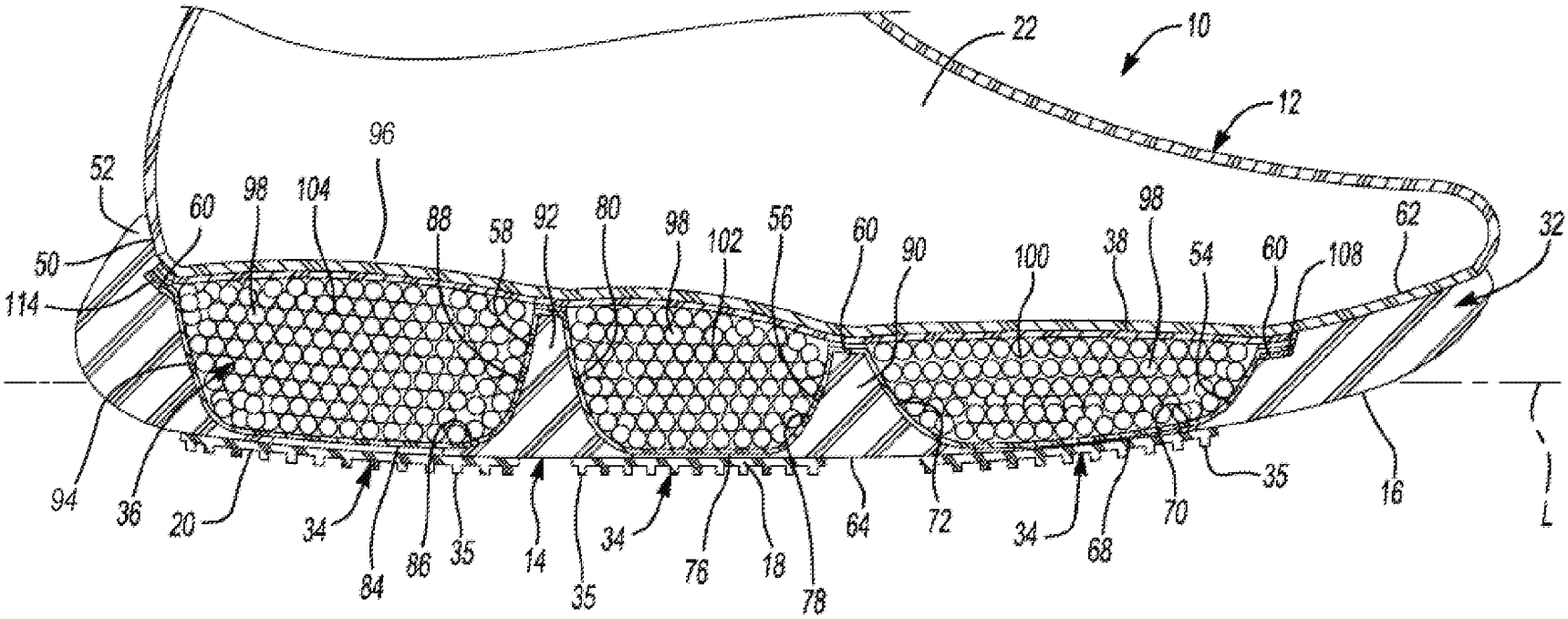
FIG. 9 is a partial cross-sectional view of the article of footwear of FIG. 1 taken along Line 9-9 of FIG. 1.

With particular reference to FIGS. 2 and 9, the midsole 32 is shown as including a first cavity 54, a second cavity 56, and a third cavity 58. As shown in FIGS. 2 and 9, the cavities 54, 56, 58 are disposed along a length of the sole structure 14 such that the first cavity 54 is disposed in the forefoot portion 16, the second cavity 56 is disposed in the midfoot portion 18, and the third cavity 58 is disposed in the heel portion 20. The cavities 54, 56, 58 are formed in a first surface 60 of the midsole 32 that opposes the substrate 38 of the upper 12. The first surface 60 is recessed from an upper surface 62 of the midsole 32 to provide clearance for a portion of the cushioning member 36 when the cushioning member 36 is disposed within the midsole 32, as will be described in greater detail below.

The midsole 32 additionally includes a second surface 64 located on an opposite side of the midsole 32 than the first surface 60. The second surface 64 opposes the outsole 34 and provides a surface to which the outsole 34 may be attached.

The cavities 54, 56, 58 are each associated with a first aperture and a second aperture of the midsole 32 that permit insertion of the cushioning member 36 into the midsole 32 and visibility of the cushioning member 36 at the outsole 34, respectively, once the cushioning member 36 is inserted into the midsole 32. Specifically, the first cavity 54 defines a first aperture 66 at a junction of the first cavity 54 and the first surface 60. The first aperture 66 defines an opening to the first cavity 54 at the first surface 60 and generally defines a shape of the first cavity 54 at the first surface 60. The first cavity 54 additionally includes a second aperture 68 disposed at an opposite end of the first cavity 54 than the first aperture 66 and formed through a bottom wall 70 of the midsole 32 within the first cavity 54. In one configuration, the bottom wall 70 and, thus, the second aperture 68 may extend in a plane that is substantially parallel to a plane defined by the first surface 60.

As described, the opening to the first cavity 54 at the first surface 60 is generally defined by the shape and size of the first aperture 66 and, further, a bottom portion of the first cavity 54 disposed at an opposite end of the first cavity 54 than the first aperture 66 is generally defined by the bottom wall 70. The first cavity 54 is further defined by a series of side surfaces 72 that extend from the bottom wall 70 to a junction of the first aperture 66 and the first surface 60 around a perimeter of the first cavity 54. Accordingly, the side surfaces 72 cooperate with one another to encircle and define a shape of the first cavity 54 between the bottom wall 70 and the first aperture 66.

The second cavity 56 is disposed generally between the first cavity 54 and the third cavity 58 along a longitudinal access (L) of the sole structure 14 (FIG. 9). The second cavity 56 includes a first aperture 74 that defines an opening to the second cavity 56 at the first surface 60. The second cavity 56 further includes a second aperture 76 disposed at an opposite end of the second cavity 56 than the first aperture 74 and formed through a bottom wall 78 of the midsole 32. As with the bottom wall 70 associated with the first cavity 54, the bottom wall 78 associated with the second cavity 56 defines a bottom of the second cavity 56 and, thus, defines a bottom surface of the second cavity 56. Side surfaces 80 extend between the first aperture 74 and the bottom wall 78 to define the overall shape of the second cavity 56. As such, the side surfaces 80 cooperate with the bottom wall 78 to define the overall shape of the second cavity 56 between the first aperture 74 and the bottom wall 78.

The third cavity 56 is disposed closer to the posterior end 44 than the first cavity 54 and the second cavity 56 and includes a first aperture 82 formed in the first surface 60 of the midsole 32. The first aperture 82 defines an opening to the third cavity 58 and generally defines a shape of a perimeter of the third cavity 58 at the first surface 60. The third cavity 58 additionally includes a second aperture 84 disposed at an opposite end of the third cavity 58 than the first aperture 82 and formed through a bottom wall 86 of the third cavity of the midsole 32. As with the first cavity 54 and the second cavity 56, the bottom wall 86 is disposed at an opposite end of the third cavity 58 than the first aperture 82 and serves to define a bottom surface of the third cavity 58. Side surfaces 88 extend from the bottom wall 86 to the first aperture 82 and cooperate to define a perimeter of the third cavity 58.

As described, each of the first cavity 54, the second cavity 56 and the third cavity 58 include respective side surfaces 72, 80, 88 that define a shape of each cavity 54, 56, 58. As shown in FIG. 9, one or more of the side surfaces 72, 80, 88 may taper in a direction from the respective first apertures 66, 74, 82 to the respective bottom walls 70, 78, 86. By providing the side surfaces 72, 80, 88 with a taper that extends from the respective first apertures 66, 74, 82 to the respective bottom walls 70, 78, 86, a volume of the cavities 54, 56, 58 is generally reduced in a direction extending from the first surface 60 of the midsole 32 to the second surface 64 of the midsole 32. As shown in FIG. 9, the degree to which the side surfaces 72, 80, 88 taper in the direction extending from the first surface 62 to the second surface 64 may vary amongst the cavities 54, 56, 58. For example, the first cavity 54 may include side surfaces 72 having a more gradual taper than either of the side surfaces 80, 88 of the second cavity 56 and the third cavity 58, respectively. Further, the side surfaces 88 of the third cavity 58 may include less of a taper than either of the side surfaces 72, 80 of the first cavity 54 and the second cavity 56, respectively.

With particular reference to FIG. 9, the first cavity 54, the second cavity 56, and the third cavity 58 are shown as being formed into the material of the midsole 32 at spaced apart locations along the longitudinal access (L) of the sole structure 14. Accordingly, a first wall 90 of the midsole 32 may extend between the first cavity 54 and the second cavity 56 and a second wall 92 may extend between the second cavity 56 and the third cavity 58. Accordingly, the first wall 90 may serve to separate the first cavity 54 from the second cavity 56 while the second wall 92 serves to separate the second cavity 56 from the third cavity 58 in a direction extending along the longitudinal access (L) of the sole structure 14. As will be described in greater detail below, the walls 90, 92 help to maintain a desired position of the cushioning member 36 relative to the midsole 32 and, thus, help to provide a desired cushioning effect to a foot of a user during use of the article of footwear 10.

With particular reference to FIGS. 2-8, the cushioning member 36 is shown as including a first barrier member 94, a second barrier member 96, and a quantity of particulate matter 98 contained within the cushioning member 36. The second barrier member 96 is a continuous sheet of material having a uniform surface extending a length of the first barrier member 94. In one configuration, the second barrier member 96 is attached to the first barrier member 94 to contain the particulate matter 98 generally between the second barrier member 96 and the first barrier member 94. For example, the first barrier member 94 and the second barrier member 96 of the cushioning member 36 may be formed together to include a first compartment 100, a second compartment 102, and a third compartment 104 each respectively incorporating a first quantity of particulate matter 98, a second quantity of particulate matter 98, and a third quantity of particulate matter 98. The first barrier member 94 is shaped to define the lower portion of the first compartment 100, the second compartment 102 and the third compartment 104.

The first barrier member 94 and the second barrier member 96 may be formed from flexible materials that allow the first barrier member 94 and the second barrier member 96 to stretch and move during use of the article of footwear 10 when the sole structure 14 is subjected to a force from a foot of a user. In one configuration, the first barrier member 94 and the second barrier member 96 are formed from different materials. For example, the first barrier member 94 may be formed from a polymer material such as thermoplastic polyurethane (TPU). Forming the first barrier member 94 from TPU allows the first barrier member 94 to be formed from an impermeable material and, in some configurations, allows the first barrier member 94 to be formed from an optically clear and/or translucent material.

The second barrier member 96 may be formed from a flexible material such as, for example, spandex. Forming the second barrier member 96 from a flexible material such as spandex also allows the second barrier member 96 to be permeable. Forming the second barrier member 96 from a permeable material permits fluid communication through the second barrier member 96 into the first compartment 100, the second compartment 102, and the third compartment 104, thereby permitting air circulation from an area external to the cushioning member 36 into the compartments 100, 102, 104.

The second barrier member 96 may be attached to the first barrier member 94 via an adhesive 106. The adhesive 106 may be a hot melt adhesive and may surround a perimeter of each of the first compartment 100, the second compartment 102, and the third compartment 104. As such, the adhesive 106 joins the material of the second barrier member 96 to the material of the first barrier member 94 between each of the compartments 100, 102, 104, thereby defining an interior void within each compartment 100, 102, 104 between the second barrier member 96 and the first barrier member 94.

Attaching the second barrier member 96 to the first barrier member 94 around a perimeter of each compartment 100, 102, 104 such that the adhesive 106 completely surrounds each compartment 100, 102, 104 creates a web member 108 in areas where the second barrier member 96 is attached to the first barrier member 94. The web member 108 may extend between each compartment 100, 102, 104 as well as around an outer perimeter of the cushioning member 36, as shown in FIG. 8. The web member 108 may include a thickness that is substantially equal to a depth of the first surface 60 of the midsole 32 relative to the upper surface 62 of the midsole 32. Further, the overall shape of the cushioning member 36 as defined by the web member 108 at a perimeter of the cushioning member 36 may include a shape that is substantially equal to a shape of the first surface 60, as formed into the upper surface 62. Accordingly, when the cushioning member 36 is inserted into the midsole, an outer surface 110, defined by the first barrier member 94 of the cushioning member 36 is substantially flush with the upper surface 62 of the midsole 32, thereby providing a uniform surface that receives the substrate 38. Providing a uniform surface that opposes the substrate 38 provides a degree of comfort to a foot of a user by preventing the user from feeling a transition or junction between the midsole 32 and the cushioning member 36.

Figure 3:
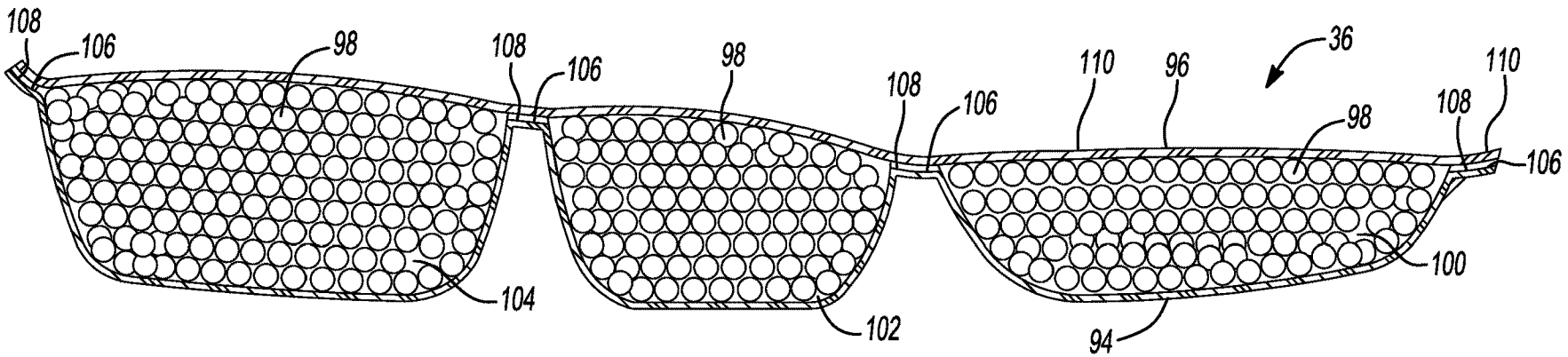
FIG. 3 is a cross-sectional view of a cushioning member of the article of footwear of FIG. 1 taken along Line 3-3 of FIG. 2.
Figure 4:
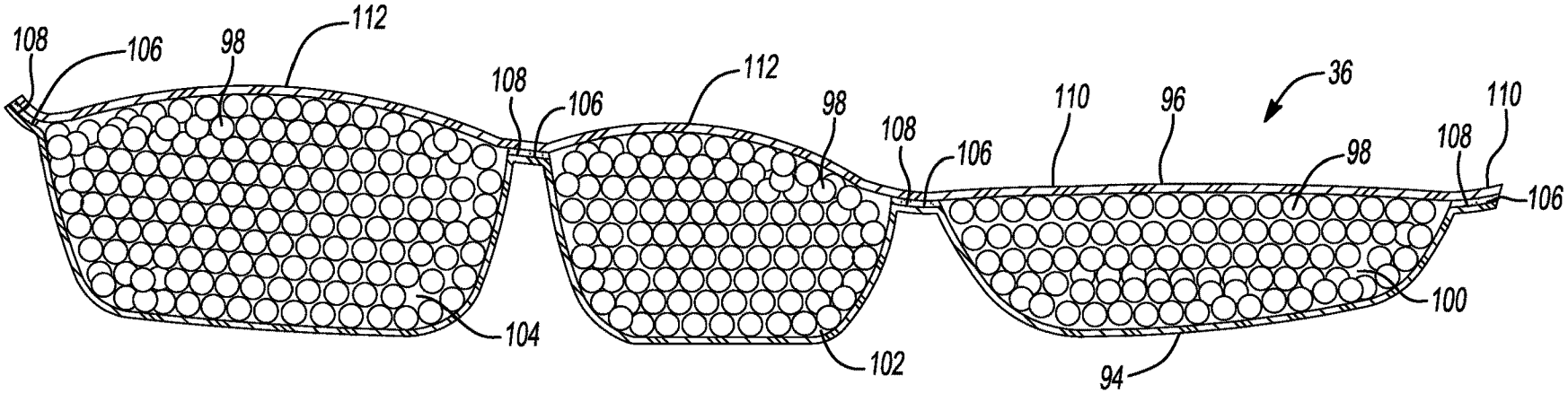
FIG. 4 is a cross-sectional view of an alternate cushioning member of the article of footwear of FIG. 1 taken along Line 3-3 of FIG. 2.

With particular reference to FIGS. 3 and 4, the cushioning member 36 is shown as including varying amounts of particulate matter 98 disposed within the compartments 100, 102, 104. For example, and with reference to FIG. 3, the first compartment 100, the second compartment 102, and the third compartment 104 are each shown as including different amounts of the particulate matter 98. Namely, the first compartment 100 disposed with the first cavity 54 and, thus, the forefoot portion 16 of the sole structure 14, includes less particulate matter 98 than the second compartment 102 and the third compartment 104. Conversely, the third compartment 104 received by the third cavity 58 of the midsole 32 and, thus, located in the heel portion 20 of the sole structure 14 receives a greater amount of particulate matter 98 than the second compartment 102 and the first compartment 100. While the compartments 100, 102, 104 are described and shown as receiving different amounts of particulate matter 98, each compartment 100, 102, 104 may receive approximately the same amount of particulate matter 98. Further, and with particular reference to FIG. 4, one or more of the compartments 100, 102, 104 may receive a volume of particulate matter 98 that creates a bulge 112 in the outer surface 110 of the cushioning member 36. For example, the second compartment 102 and the third compartment 104 of the cushioning member 36 shown in FIG. 4 each include a bulge 112 that extends from a nominal plane defined by the second barrier member 96 at a location of the second compartment 102 and the third compartment 104. Namely, the bulges 112 extend from a nominal plane defined by the web member 108 and may be formed by overfilling one or more of the compartments 100, 102, 104 with particulate matter 98. In one configuration each of the compartments 100, 102, 104 is overfilled, thereby creating a bulge 112 in the outer surface 110 at each compartment 100, 102, 104. For example, the forward most compartment 100 may be overfilled by approximately 5-10%, the middle compartment 102 may be overfilled by approximately 15-20%, and the rearward most compartment 104 may be overfilled by approximately 25-30%.

Overfilling the compartments 100, 102, 104 may be accomplished by providing an amount of particulate matter 98 that would otherwise not fit within the compartments 100, 102, 104 which, in turn, creates the bulge 112 in the outer surface 110. In other words, the volume of the overfilled particulate matter 98 is more than would otherwise fit within each compartment 100, 102, 104 absent the second barrier member 96. By way of example, if the compartment 104 includes a volume that can contain 100 discrete pieces of particulate matter 98, providing the compartment 104 with 30% more particulate matter 98 results in providing the compartment 104 with 130 discrete pieces of particulate matter 98 (i.e., 100 plus 30% or 30 additional discrete pieces of particulate matter 98). These additional 30 discrete pieces of particulate matter 98 are held in position relative to the compartment 104 by the second barrier member 96 and, in turn, form the bulge at the outer surface 110.

Figure 5:
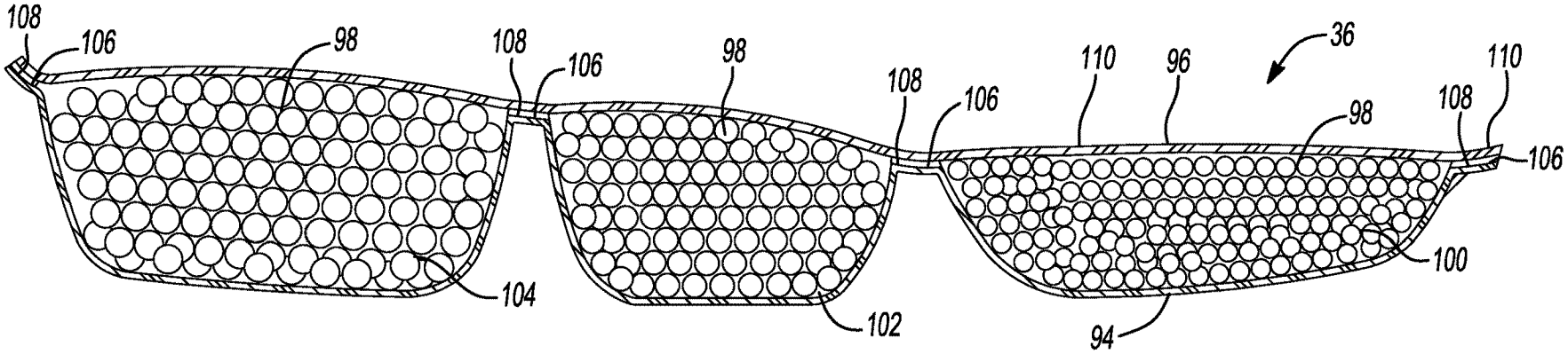
FIG. 5 is a cross-sectional view of an alternate cushioning member of the article of footwear of FIG. 1 taken along Line 3-3 of FIG. 2.
Figure 6:
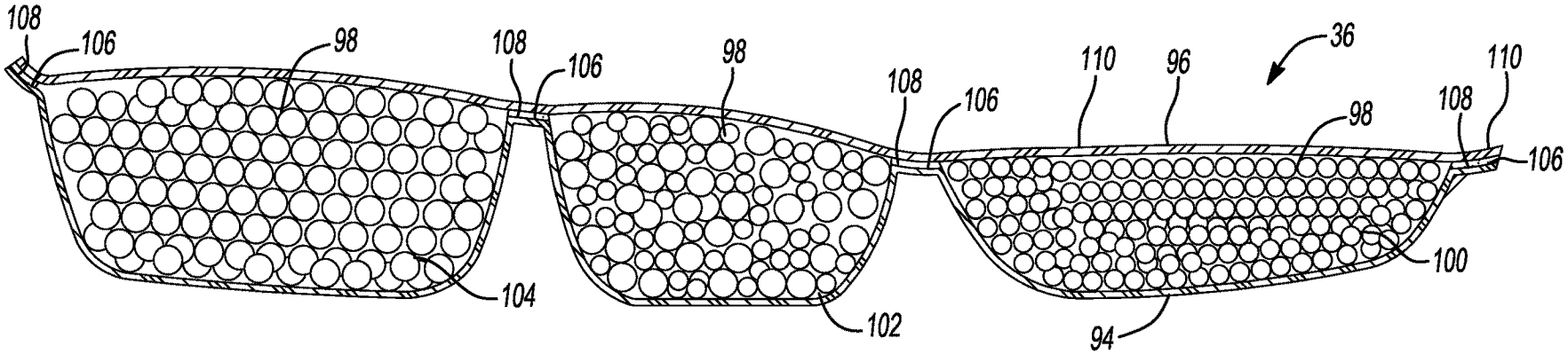
FIG. 6 is a cross-sectional view of an alternate cushioning member of the article of footwear of FIG. 1 taken along Line 3-3 of FIG. 2.
Figure 7:
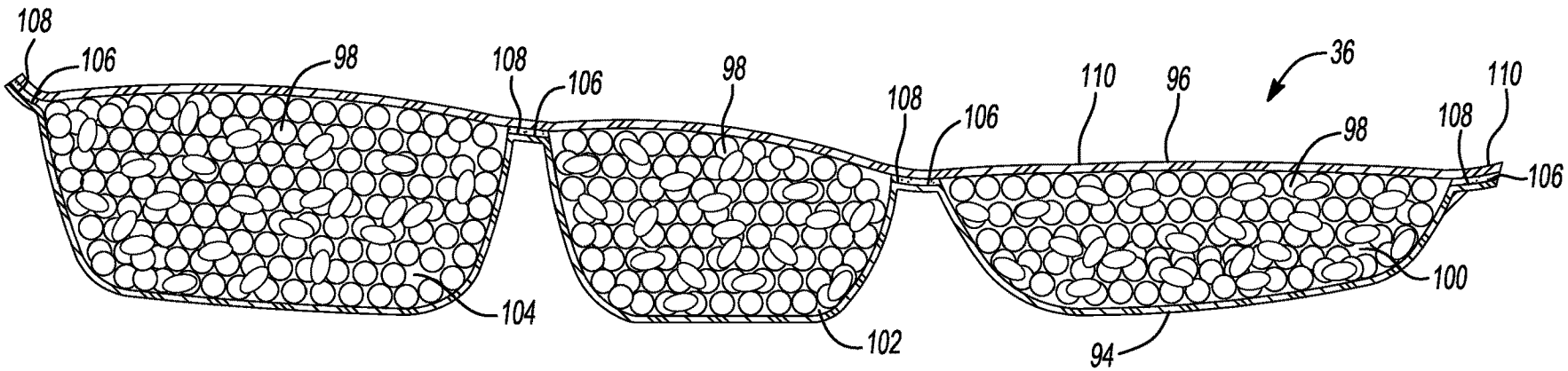
FIG. 7 is a cross-sectional view of an alternate cushioning member of the article of footwear of FIG. 1 taken along Line 3-3 of FIG. 2.

Regardless of the amount of particulate matter 98 disposed within the respective compartments 100, 102, 104, the particulate matter 98 may be used to enhance the functionality and cushioning characteristics that the material of the midsole 32 provides. For example, the particulate matter 98 contained within the compartments 100, 102, 104 may include foam beads having a substantially spherical shape and/or a substantially oval shape (FIG. 7). Further, the foam beads defining the particulate matter 98 may have approximately the same size and shape or, alternatively, may have at least one of a different size and shape. For example, the compartments 100, 102, 104 may each include particulate matter 98 having a different size, as shown in FIG. 5, whereby the particulate matter 98 decreases in size (i.e., a different diameter in the example provided) from compartment 104 to compartment 100. Alternatively, the middle compartment 102 may include a mixture of different-sized particulate matter 98 while the other two compartments 100, 104 include same-sized particulate matter 98. In the example provided, the other two compartments 100, 104 include same-sized particulate matter 98 within each compartment 100, 104 but have different-sized particulate matter 98 relative to one another. While the compartments 100, 104 are shown as including different-sized particulate matter 98 (i.e., the particulate matter 98 disposed within compartment (100) is smaller (i.e., in diameter) than the particulate matter 98 disposed within compartment (104)), the compartments 100, 104 could alternatively include same-sized particulate matter 98. Regardless of the particular size and shape of the particulate matter 98, the particulate matter 98 cooperates with the outsole 34 and the midsole 32 to provide the article of footwear 10 with a cushioned and responsive performance during use.

The cushioning member 36 may be inserted into the midsole 32 such that the first compartment 100 is received by the first cavity 54, the second compartment 102 is received by the second cavity 56, and the third compartment 104 is received by the third cavity 58, wherein the first barrier member 94 opposes and is in contact with the first cavity 54, the second cavity 56 and the third cavity 58, as illustratively shown in FIGS. 9, 10, 13 and 14. Once the cushioning member 36 is disposed within the midsole 32, the surface 110 of the cushioning member 36 is substantially flush with the upper surface 62 of the midsole 32 at the web member 108 that defines a perimeter of the cushioning member 36. As such, the second barrier member 96 cooperates with the material of the midsole 32 at the upper surface 62 of the midsole 32 to provide a generally uniform surface against which the substrate 38 resides when the sole structure 14 is attached to the upper 12.

The outsole 34 may be formed from a transparent or translucent material and may include one or more discreet portions that are separate from one another. The outsole 34 may be formed from a durable material such as, for example, rubber and may be attached to the second surface 64 of the midsole 32. The individual portions of the outsole 34 may be attached to the second surface 64 of the midsole 32 proximate to the second apertures 68, 76, 84, respectively associated with the first cavity 54, the second cavity 56, and the third cavity 58. The portions of the outsole 34 may be separated from one another along a length of the sole structure 14 in a direction substantially parallel to the longitudinal axis (L). While the outsole 34 is described and shown as including individual portions that are spaced apart from one another, the outsole 34 could alternatively have a unitary construction that extends generally across the entire second surface 64 of the midsole 32 such that the outsole 34 extends continuously between the anterior end 42 and the posterior end 44 and between the medial side 46 and the lateral side 48. Regardless of the particular construction of the outsole 34 (i.e., unitary or discrete portions), the outsole 34 may include treads 35 that extend from the outsole 34 to provide increased traction with a ground surface during use of the article of footwear 10.

Forming the outsole 34 from a transparent or translucent material allows the cavities 54, 56, 58 to be viewed from the outsole 34 when the outsole 34 is attached to the midsole 32 at the second surface 64. Further, because the compartments 100, 102, 104 substantially fill the respective cavities 54, 56, 58 of the midsole 32, the compartments 100, 102, 104 and, thus, the particulate matter 98 disposed therein is likewise visible at the second apertures 68, 76, 84 of the midsole 32 through the material of the outsole 34. Accordingly, the particulate matter 98 residing within the respective compartments 100, 102, 104 of the cushioning member 36 is visible through the outsole 34 at the second apertures 68, 76, 84 associated with the respective cavities 54, 56, 58.

Figure 10:
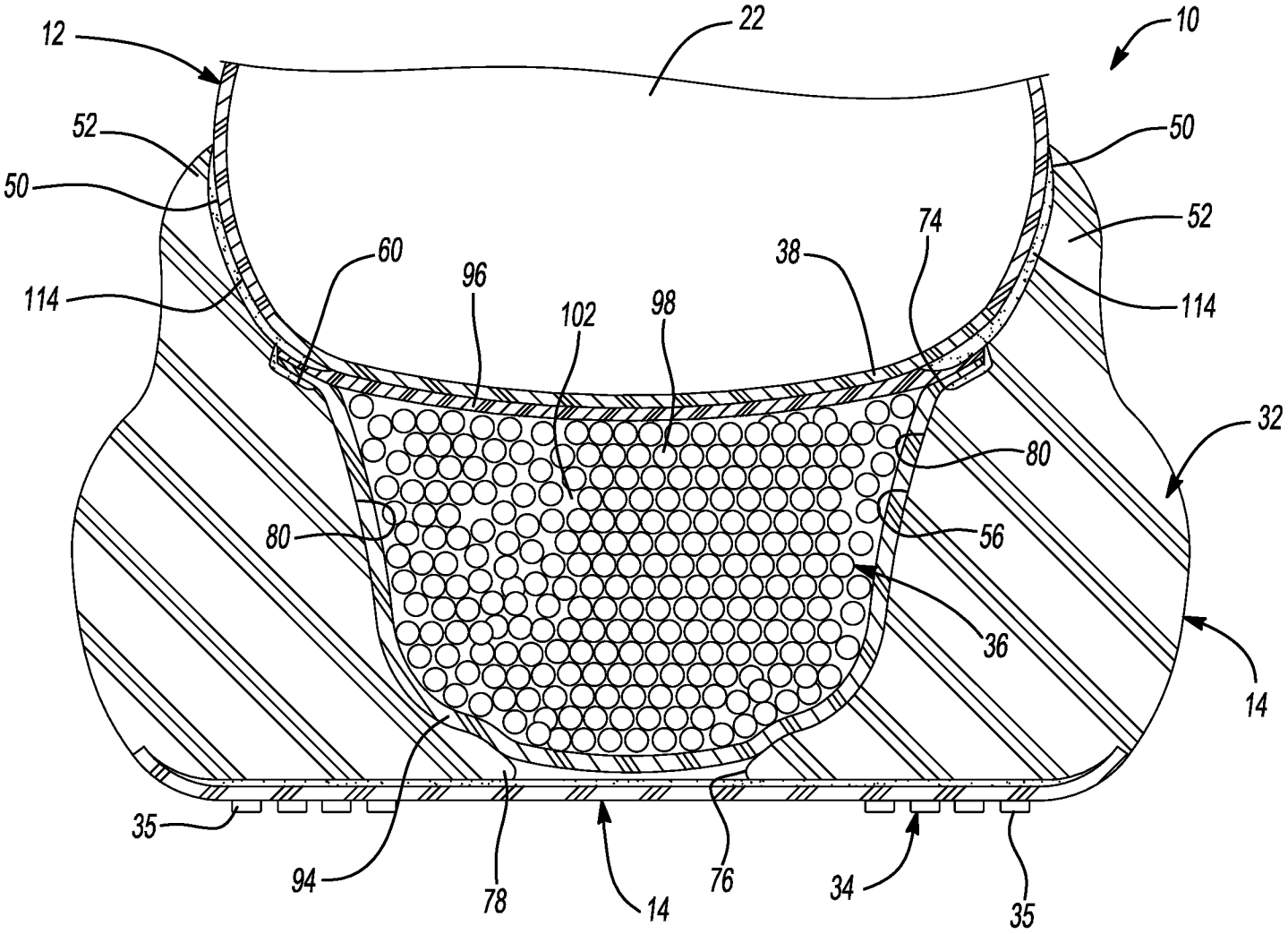
FIG. 10 is a partial cross-sectional view of the article of footwear of FIG. 1 taken along Line 10-10 of FIG. 1.
Figure 11:
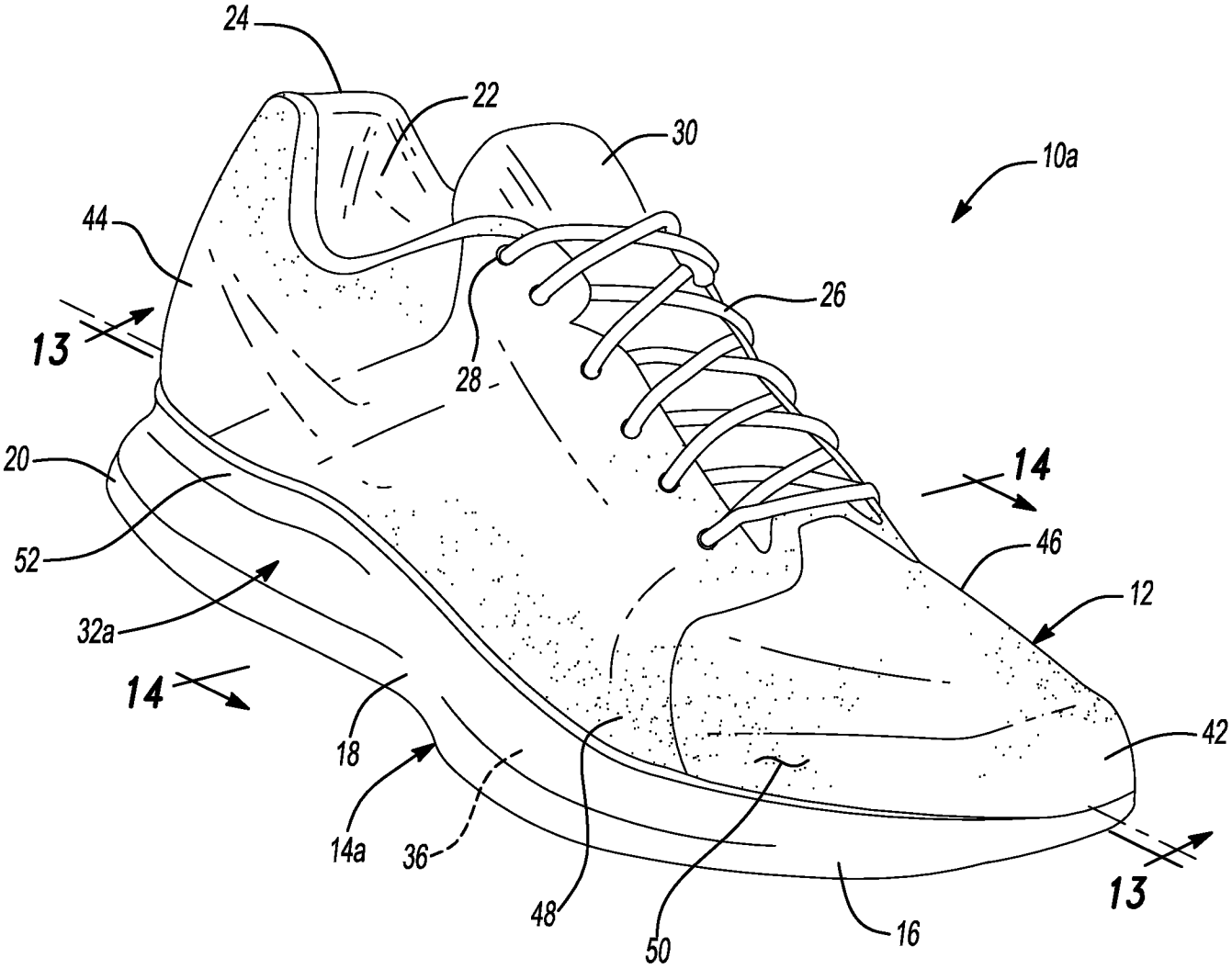
FIG. 11 is a perspective view of an article of footwear in accordance with the principals of the present disclosure.
Figure 12:
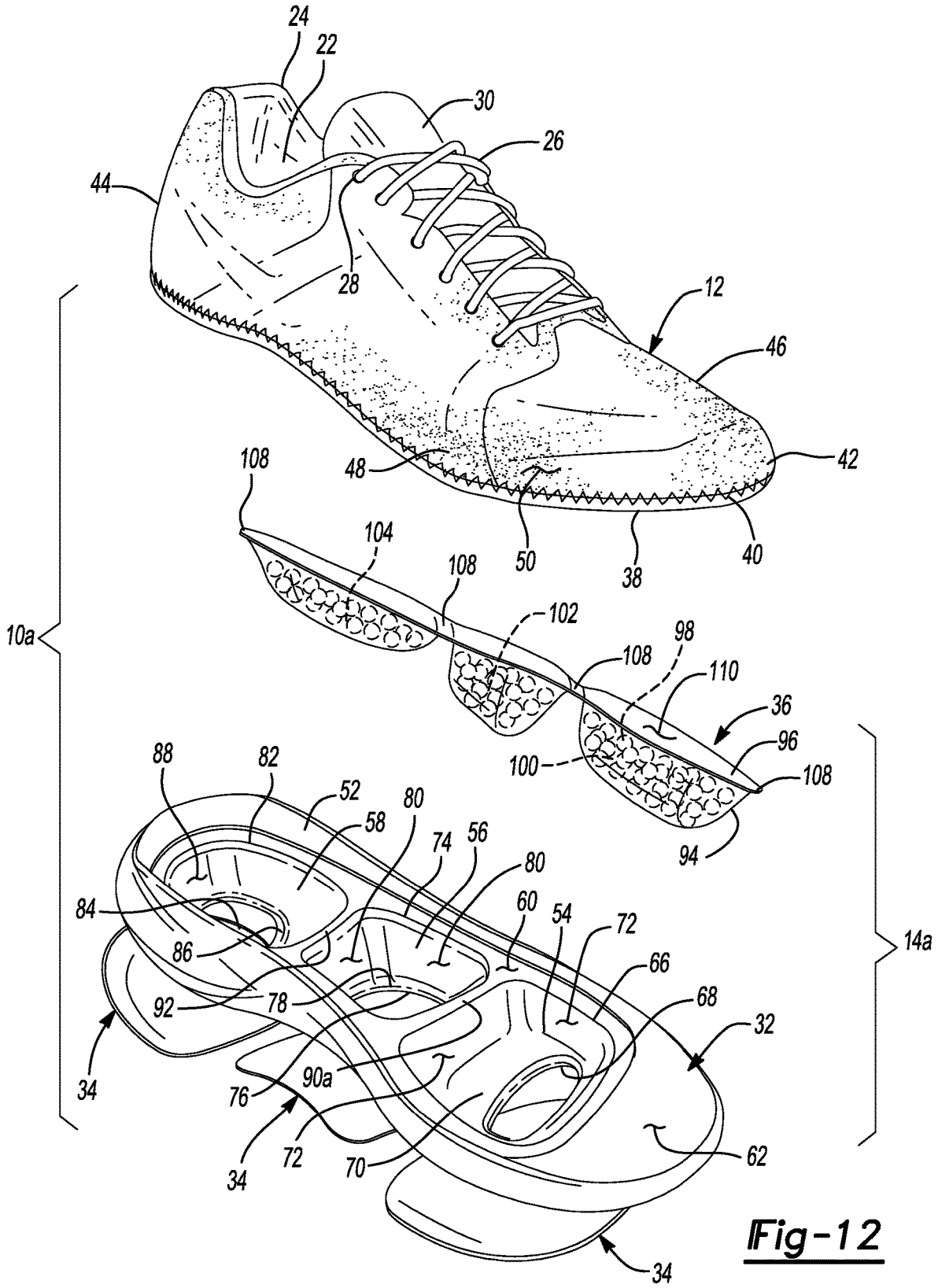
FIG. 12 is an exploded view of the article of footwear of FIG. 11.

The sole structure 14 may be attached to the upper 12 via a suitable adhesive 114 (FIG. 10). For example, the adhesive 114 may extend between and attach the projection 52 of the midsole 32 to the outer surface 50 of the upper 12. Further, the adhesive 114 may attach the web member 108 of the cushioning member 36 to the midsole 32 at a junction of the web member 108 and the first surface 60 of the midsole 32.

During use, a force may be exerted on the midsole 32 and the cushioning member 36 at the substrate 38 when a user's foot is disposed within the interior void 22 of the upper 12. A downward force, for example, may displace the particulate matter 98 disposed within the respective compartments 100, 102, 104 and, further, may compress a material of the midsole 32. In so doing, the particulate matter 98 and, thus, the material of the midsole 32 provides a degree of cushioning to the foot of the user. The shape of the midsole 32 at the cavities 54, 56, 58 along with the relatively flexible material of the first barrier member 94 and the second barrier member 96 allows the material of the barrier members 94, 96 to flex as the particulate matter 98 moves relative to and within the respective compartments 100, 102, 104. Further, providing the midsole 32 with the walls 90, 92 that generally separate the compartments 100, 102, 104 not only provides a degree of cushioning when the walls 90, 92 are compressed but, additionally, serves to maintain a desired shape of the compartments 100, 102, 104, thereby preventing expansion of the compartments 100, 102, 104 beyond a predetermined amount.

With reference to FIGS. 11-14, an article of footwear **10*a* is provided and includes an upper 12 and a sole structure 14*a* attached to the upper 12. In view of the substantial similarity in structure and function of the components associated with the article of footwear 10 with respect to the article of 10*a***, like reference numerals are use hereinafter and in the drawings to identify like components while like reference numerals containing letters extensions are used to identify those components that have been modified.

The sole structure **14*a* is identical to the sole structure 14 associated with the article of footwear 10 with the exception of the midsole 32*a*. Namely, the midsole 32*a* of the sole structure 14*a* includes a first wall 90*a* having a reduced height relative to the first wall 90 of the midsole 32**.

Figure 13:
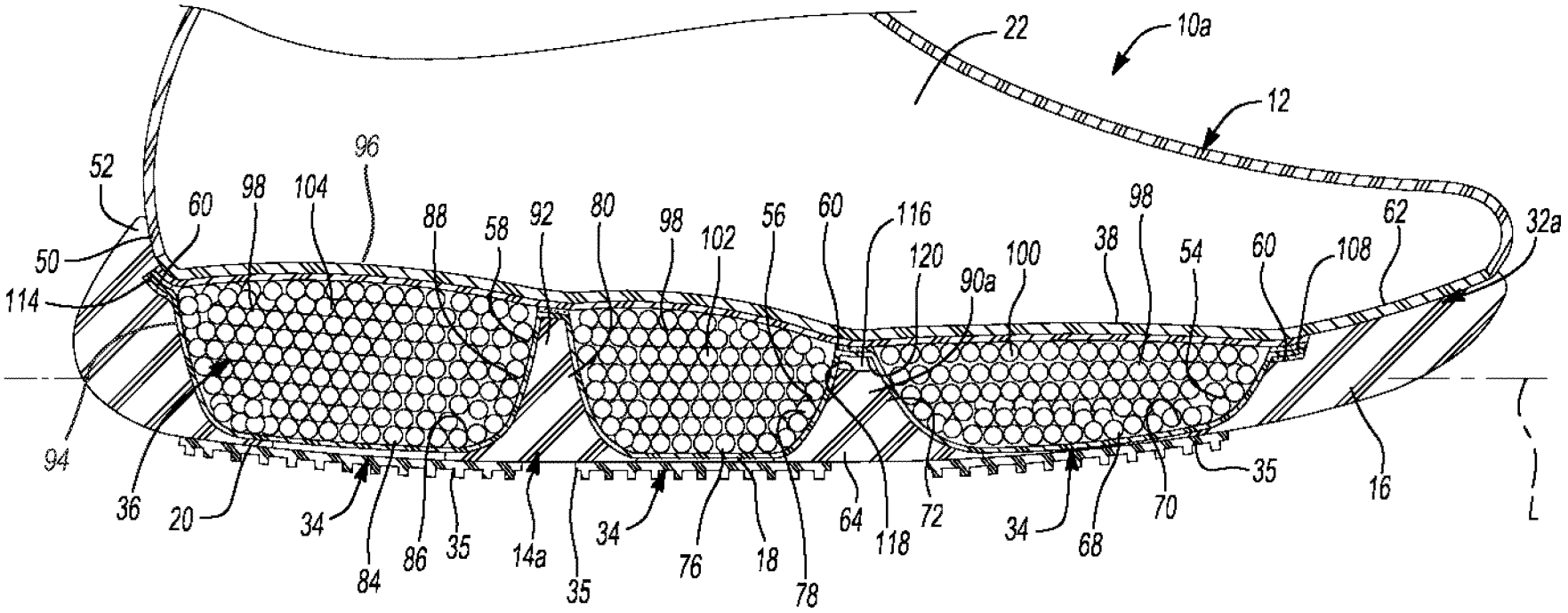
FIG. 13 is a partial cross-sectional view of the article of footwear of FIG. 11 taken along Line 13-13 of FIG. 11.
Figure 14:
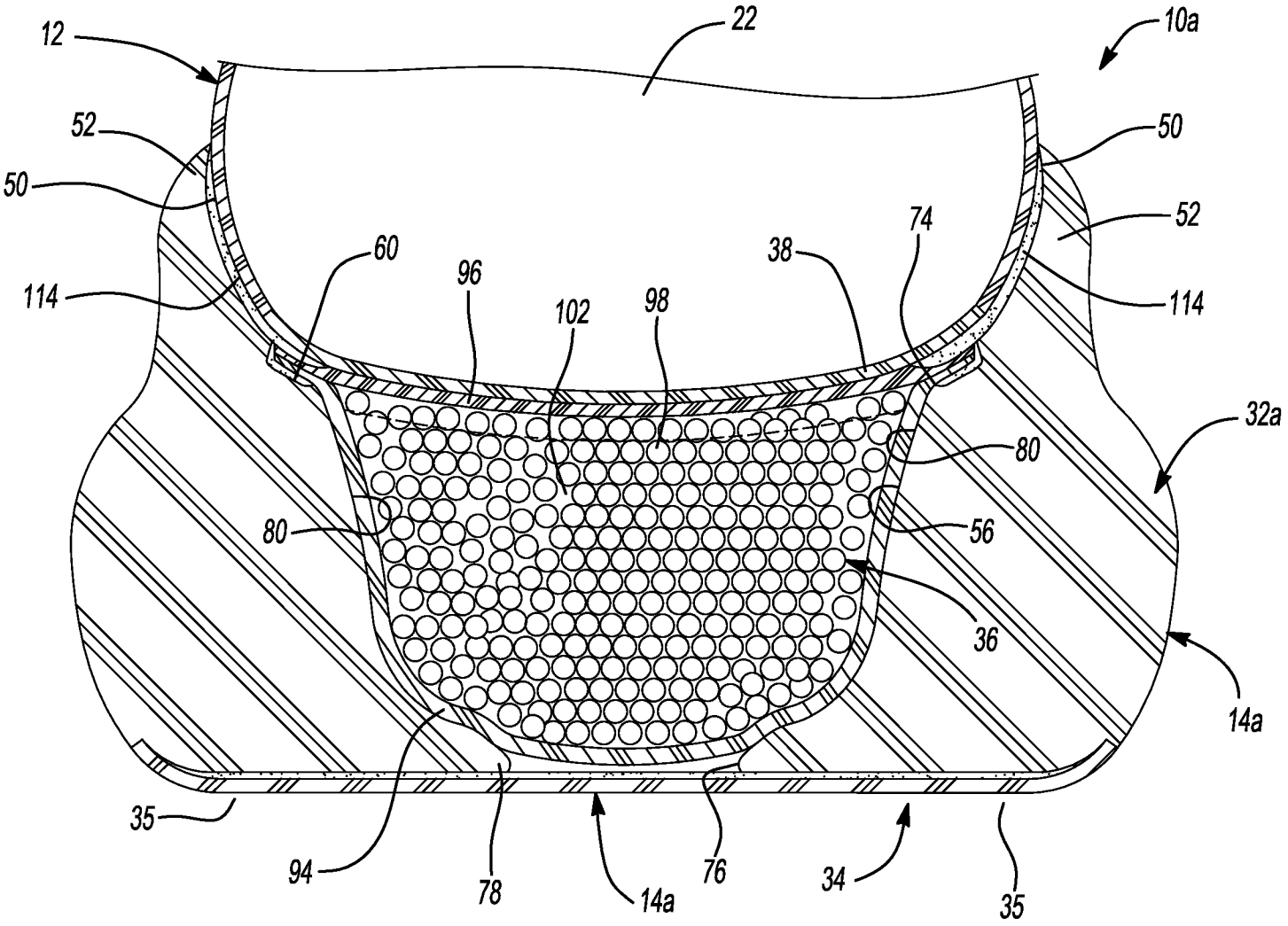
FIG. 14 is a partial cross-sectional view of the article of footwear of FIG. 11 taken along Line 14-14 of FIG. 11.

With particular reference to FIG. 13, the reduced height of the first wall 90 of the midsole **32*a* relative to the first wall 90 of the midsole 32 results in a gap 116 being disposed between a distal end 118 of the first wall 90*a* and a lower surface 120 of the first barrier member 94 at the web member 108. Accordingly, the distal end 118 of the first wall 90*a* opposes the surface 120 of the first barrier member 94** at the web member 108 and is spaced apart and separated from the surface 120 when the article of footwear 10*a* is in a relaxed state (i.e., when a force of a predetermined magnitude is not applied to the sole structure 14*a* at the substrate 38).

When a force of a predetermined magnitude is applied to the sole structure 14*a* at the substrate 38, the cushioning member 36 at the first barrier member 94 and the second barrier member 96 is displaced, thereby causing the surface 120 of the first barrier member 94 to move toward the distal end 118 of the first wall 90*a*. In so doing, the gap 116 is reduced until the surface 120 of the first barrier member 94 contacts the distal end 118 of the first wall 90*a*.

When the surface 120 of the first barrier member 94 contacts the distal end 118 of the first wall 90, the force applied to the substrate 38 and to the cushioning member 36 is transmitted to the midsole 32*a* at the first wall 90*a*. The force received by the first wall 90*a* causes compression of the material of the midsole 32*a* at the first wall 90*a*, thereby allowing the material of the midsole 32*a* at the first wall 90*a* to absorb the applied force along with the cushioning member 36 and the remainder of the midsole 32*a*.

Relative to the sole structure 14 of the article of footwear 10, the sole structure 14*a* of the article footwear 10*a* similarly provides a user with a degree of cushioning and comfort during use of the article footwear 10*a*. However, providing the gap 116 between the first wall 90*a* and the web member 108 of the cushioning member 36 in the sole structure 14*a*, provides for additional deflection of the cushioning member 36 relative to the amount of deflection of the cushioning member 36 of the sole structure 14 when subjected to the same load. Permitting additional deflection of the cushioning member 36 allows a user to more deeply engage the particulate matter 98 disposed within the first compartment 100 and the second compartment 102 of the cushioning member 36. For example, because the cushioning member 36 is permitted to close the gap 116 without having to compress the material of the midsole 32*a* at the first wall 90*a*, deflection of the cushioning member 36 in a direction toward the midsole 32*a* requires less force, as the material of the midsole 32*a* does not inhibit such movement at the location of the first wall 90*a* until the surface 120 of the first barrier member 94 contacts the surface 118 of the first wall 90. Accordingly, a user's foot may more easily engage the particulate matter 98 disposed within the first compartment 100 and the second compartment 102, thereby allowing the user's foot to engage the particulate matter 98 within the first compartment 100 and the second compartment 102 to a greater extent than a user's foot would engage the particulate matter 98 of the first compartment 100 and the second compartment 102 of the sole structure 14 at a given applied load.

Regardless of the particular sole structure 14, 14*a*, incorporation of the cushioning member 36 into the article footwear 10, 10*a* provides a degree of comfort and cushioning to a foot of a user during use. For example, and as described above, the substrate 38 and the second barrier member 96 of the cushioning member 36 are formed from flexible materials. Accordingly, when a force is applied on the substrate 38 during use of the article footwear by a foot of a user, the force causes the substrate 38 and the material of the second barrier member 96 to flex and stretch, thereby allowing the foot of the user to engage and displace the particulate matter 98 disposed within the compartments 100, 102, 104. In so doing, the particulate matter 98 exerts a force on the material of the first barrier member 94, thereby causing the first barrier member 94 to likewise flex and stretch. Such movement of the first barrier member 94 compresses a material of the midsole 32, 32*a* generally surrounding the compartments 100, 102, 104 which, in turn, absorbs forces associated with a walking or running movement.

Flexing and stretching of the materials of the substrate 38, the first barrier member 94, and the second barrier 96 along with compression of the material of the midsole 32, 32*a* provides a degree of cushioning and comfort to a user while wearing the article of footwear 10, 10*a*. Further, interaction between a foot of a user with the particulate matter 98—permitted by the generally flexible nature of the material of the substrate 38 and the second barrier member 96—likewise provides cushioning to the foot of the user. Further, because of the particulate matter 98 is permitted to move relative to and within each compartment 100, 102, 104, the particulate matter 98 conforms to a shape of the user's foot and, thus, provides a degree of tailored cushioning that is specific to the shape of the user's foot. Further yet, because the particulate matter 98 is permitted to move relative to and within the first compartment 100, the second compartment 102, and the third compartment 104, the shape of the substrate 38 and the second barrier member 96 is dynamic and is largely based on the applied loads at the substrate 38 at any given time. In other words, the support provided by the particulate matter 98 disposed within the compartments 100, 102, 104 moves and shifts in response to the applied forces at the substrate 38. In so doing, the effective shape of the substrate 38 and the second barrier member 96 is constantly changing as the user applies forces at different locations of the substrate 38, thereby causing the particulate matter 98 to shift and move relative to within the compartments 100, 102, 104. As such, the cushioning member 36 provides the sole structure 14, 14*a* and, thus, the article of footwear 10, 10*a* with cushioning and support that dynamically responds to an applied force and automatically conforms to a shape of the user's foot, thereby providing the user with a tailored and personal cushioning system.

The following Clauses provide an exemplary configuration for an article of footwear described above.

Clause 1: A cushioning member for an article of footwear comprising a first barrier member defining a first compartment and a second compartment and being formed from a first material, a second barrier member attached to the first barrier member, covering the first compartment to define a first interior void, and covering the second compartment to define a second interior void, the second barrier member being formed from a second material different than the first material, a first quantity of particulate matter disposed within the first interior void, and a second quantity of particulate matter disposed within the second interior void.

Clause 2: The cushioning member of Clause 1, wherein the first material is a polymer.

Clause 3: The cushioning member of Clause 1, wherein the first material is thermoplastic polyurethane (TPU).

Clause 4: The cushioning member of any of the preceding clauses, wherein the second material is spandex.

Clause 5: The cushioning member of Clause 1, wherein one of the first material and the second material is permeable and the other of the first material and the second material is impermeable.

Clause 6: The cushioning member of Clause 1, wherein the first material is impermeable and the second material is permeable.

Clause 7: The cushioning member of Clause 1, wherein the first quantity of particulate matter and the second quantity of particulate matter are approximately the same.

Clause 8: The cushioning member of Clause 1, wherein the first quantity of particulate matter and the second quantity of particulate matter are different.

Clause 9: The cushioning member of any of the preceding clauses, wherein at least one of the first quantity of particulate matter and the second quantity of particulate matter includes foam beads.

Clause 10: The cushioning member of Clause 9, wherein the foam beads include a substantially spherical shape.

Clause 11: The cushioning member of Clause 9, wherein the foam beads include approximately the same size and shape.

Clause 12: The cushioning member of Clause 9, wherein the foam beads include at least one of a different size and shape.

Clause 13: The cushioning member of any of the preceding clauses, further comprising an adhesive disposed between the first barrier member and the second barrier member.

Clause 14: The cushioning member of Clause 13, wherein the adhesive surrounds the first compartment and the second compartment.

Clause 15: The cushioning member of Clause 14, wherein the adhesive is a hot melt adhesive.

Clause 16: The cushioning member of any of the preceding clauses, wherein the first compartment and the second compartment taper in a direction away from the second barrier member.

Clause 17: An article of footwear incorporating the cushioning member of any of the preceding clauses.

Clause 18: A sole structure for an article of footwear comprising a midsole defining a first cavity and a second cavity and a cushioning member including a first compartment received by the first cavity and containing a first quantity of particulate matter and a second compartment received by the second cavity and containing a second quantity of particulate matter, the cushioning member including a first barrier member and a second barrier member that cooperate to contain the first quantity of particulate matter within the first compartment and cooperate to contain the second quantity of particulate matter within the second compartment.

Clause 19: The sole structure of Clause 18, wherein the first barrier member defines the first compartment and the second compartment and the second barrier member is attached to the first barrier member.

Clause 20: The sole structure of Clause 18, further comprising an adhesive disposed between the first barrier member and the second barrier member.

Clause 21: The sole structure of Clause 20, wherein the adhesive surrounds the first compartment and the second compartment.

Clause 22: The sole structure of Clause 21, wherein the adhesive is a hot melt adhesive.

Clause 23: The sole structure of any of the preceding clauses, wherein the first compartment and the second compartment taper in a direction away from the second barrier member.

Clause 24: The sole structure of any of the preceding clauses, wherein the second barrier member covers the first compartment to define a first interior void and covers the second compartment to define a second interior void, the first quantity of particulate matter being disposed within the first interior void and the second quantity of particulate matter being disposed within the second interior void.

Clause 25: The sole structure of any of any of the preceding clauses, wherein the first barrier member is formed from a first material and the second barrier member is formed from a second material different than the first material.

Clause 26: The sole structure of Clause 25, wherein the first material is a polymer.

Clause 27: The sole structure of Clause 25, wherein the first material is thermoplastic polyurethane (TPU).

Clause 28: The sole structure of any of Clauses 25-27, wherein the second material is spandex.

Clause 29: The sole structure of Clause 25, wherein one of the first material and the second material is permeable and the other of the first material and the second material is impermeable.

Clause 30: The sole structure of Clause 25, wherein the first material is impermeable and the second material is permeable.

Clause 31: The sole structure of Clause 18, wherein the first quantity of particulate matter and the second quantity of particulate matter are approximately the same.

Clause 32: The sole structure of Clause 18, wherein the first quantity of particulate matter and the second quantity of particulate matter are different.

Clause 33: The sole structure of any of the preceding clauses, wherein at least one of the first quantity of particulate matter and the second quantity of particulate matter includes foam beads.

Clause 34: The sole structure of Clause 33, wherein the foam beads include a substantially spherical shape.

Clause 35: The sole structure of Clause 33, wherein the foam beads include approximately the same size and shape.

Clause 36: The sole structure of Clause 33, wherein the foam beads include at least one of a different size and shape.

Clause 37: The sole structure of Clause 18, wherein the midsole extends between the first compartment and the second compartment.

Clause 38: The sole structure of Clause 18, wherein the cushioning member includes a web portion extending between and connecting the first compartment and the second compartment.

Clause 39: The sole structure of Clause 38, wherein the midsole is attached to the cushioning member at the web portion.

Clause 40: The sole structure of Clause 38, wherein the midsole is spaced apart from the cushioning member at the web portion.

Clause 41: A sole structure for an article of footwear comprising an outsole, a midsole including a first cavity, a first aperture formed in a first surface of the midsole and in fluid communication with the first cavity, and a second aperture formed in a second surface of the midsole and in fluid communication with the first cavity, the second surface disposed on an opposite side of the midsole than the first surface and opposing the outsole, and a cushioning member including a first compartment received by the first cavity and containing a first quantity of particulate matter that is visible through the second aperture at the outsole.

Clause 42: The sole structure of Clause 41, wherein the cushioning member includes a first barrier member and a second barrier member that cooperate to contain the first quantity of particulate matter within the first compartment.

Clause 43: The sole structure of Clause 41, wherein the first barrier member defines the first compartment and the second barrier member is attached to the first barrier member.

Clause 44: The sole structure of Clause 42, further comprising an adhesive disposed between the first barrier member and the second barrier member.

Clause 45: The sole structure of Clause 44, wherein the adhesive surrounds the first compartment.

Clause 46: The sole structure of Clause 44, wherein the adhesive is a hot melt adhesive.

Clause 47: The sole structure of any of Clauses 42-46, wherein the first compartment tapers in a direction away from the second barrier member.

Clause 48: The sole structure of any of Clauses 42-47, wherein the second barrier member covers the first compartment to define a first interior void, the first quantity of particulate matter being disposed within the first interior void.

Clause 49: The sole structure of any of any of Clauses 42-48, wherein the first barrier member is formed from a first material and the second barrier member is formed from a second material different than the first material.

Clause 50: The sole structure of Clause 49, wherein the first material is a polymer.

Clause 51: The sole structure of Clause 49, wherein the first material is thermoplastic polyurethane (TPU).

Clause 52: The sole structure of any of Clauses 49-51, wherein the second material is spandex.

Clause 53: The sole structure of Clause 49, wherein one of the first material and the second material is permeable and the other of the first material and the second material is impermeable.

Clause 54: The sole structure of Clause 49, wherein the first material is impermeable and the second material is permeable.

Clause 55: The sole structure of any of the preceding clauses, wherein the first quantity of particulate matter includes foam beads.

Clause 56: The sole structure of Clause 55, wherein the foam beads include a substantially spherical shape.

Clause 57: The sole structure of Clause 55, wherein the foam beads include approximately the same size and shape.

Clause 58: The sole structure of Clause 55, wherein the foam beads include at least one of a different size and shape.

Clause 59: The sole structure of Clause 41, wherein the outsole is formed from one of a transparent material and a translucent material, the first quantity of particulate matter being visible at the second aperture through the material of the outsole.

Clause 60: The sole structure of any of the preceding clauses, wherein the midsole includes a second cavity, a third aperture formed in the first surface of the midsole and in fluid communication with the second cavity, and a fourth aperture formed in the second surface of the midsole and in fluid communication with the second cavity.

Clause 61: The sole structure of Clause 60, wherein the cushioning member includes a second compartment received by the second cavity of the midsole and containing a second quantity of particulate matter.

Clause 62: The sole structure of Clause 61, wherein the second quantity of particulate matter is visible through the fourth aperture at the outsole.

Clause 63: The sole structure of Clause 41, wherein an outer surface of the cushioning member is substantially flush with the first surface of the midsole.

Clause 64: The sole structure of Clause 41, wherein an outer surface of the cushioning member protrudes from the first surface of the midsole to define at least one bulge.

Clause 65: The sole structure of Clause 64, wherein the at least one bulge is formed at the first compartment.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A cushioning member for an article of footwear having an upper and a midsole configured to support the cushioning member, the upper including a substrate that opposes the midsole, the cushioning member comprising: a first barrier member defining a first compartment and a second compartment and being formed from a first material, the first compartment and the second compartment arranged in series along a length of the cushioning member and cooperating with one another to provide the cushioning member with a height that tapers in a direction from a posterior end of the cushioning member to an anterior end of the cushioning member; a second barrier member attached to the first barrier member, the second barrier member being a continuous sheet of material having a uniform surface extending a length of the first barrier member so as to cover the first compartment and the second compartment and define a first interior void and a second interior void, the second barrier member being formed from a second material different than the first material, the first barrier member and the second barrier member completely enclosing the first interior void and the second interior void; a first quantity of particulate matter disposed within the first interior void; a second quantity of particulate matter disposed within the second interior void, the first quantity of particulate matter and the second quantity of particulate matter held beneath the uniform surface of the second barrier member, the uniform surface of the second barrier member opposing a bottom surface of the substrate to provide a degree of comfort to a foot of a user by preventing the user from feeling a transition or junction between the midsole and the cushioning member; and wherein one of the first material and the second material is permeable and the other of the first material and the second material is impermeable.

2. The cushioning member of claim 1, wherein the first material is a polymer.

3. The cushioning member of claim 1, wherein the first material is thermoplastic polyurethane (TPU).

4. The cushioning member of claim 1, wherein the second material is spandex.

5. The cushioning member of claim 1, wherein the first material is impermeable and the second material is permeable.

6. The cushioning member of claim 1, wherein the first quantity of particulate matter and the second quantity of particulate matter are approximately the same.

7. The cushioning member of claim 1, wherein the first quantity of particulate matter and the second quantity of particulate matter are different.

8. The cushioning member of claim 1, wherein at least one of the first quantity of particulate matter and the second quantity of particulate matter includes foam beads.

9. The cushioning member of claim 1, wherein an adhesive surrounds the first compartment and the second compartment so as to form a web bounding the first compartment and the second compartment, a portion of the web extending transverse to the length of the cushioning member.

10. The cushioning member of claim 9, wherein the adhesive is a hot melt adhesive.

11. An article of footwear incorporating the cushioning member of claim 1.

12. A sole structure for an article of footwear including an upper having a substrate, the sole structure comprising:

a midsole opposing the substrate and defining a first cavity, a second cavity, and a wall dividing the first cavity and the second cavity; and a cushioning member including a first barrier member having a first compartment, a second compartment, and a web separating the first compartment and the second compartment and disposed on a top surface of the wall, the first compartment received by the first cavity and containing a first quantity of particulate matter and the second compartment received by the second cavity and containing a second quantity of particulate matter, the cushioning member further including a second barrier member (i) formed as a continuous sheet of material having a uniform surface, (ii) being laid over the first barrier member and opposing the substrate so as to be positioned between the midsole and the substrate, and (iii) cooperating with the first barrier member to contain the first quantity of particulate matter within the first compartment and the second quantity of particulate matter within the second compartment, the first quantity of particulate matter and the second quantity of particulate matter being held beneath the uniform surface of the second barrier member, wherein the first barrier member is formed from a first material and the second barrier member is formed from a second material different than the first material, the first material being impermeable and the second material being permeable.

13. The sole structure of claim 12, wherein the first barrier member opposes and is in contact with the midsole within the first cavity and the second cavity.

14. The sole structure of claim 12, further comprising an adhesive disposed between the first barrier member and the second barrier member, the adhesive surrounding the first compartment and the second compartment so as to form the web bounding the first compartment and the second compartment, a portion of the web transverse to the length of the cushioning member.

15. The sole structure of claim 12, wherein the first compartment and the second compartment taper in a direction away from the second barrier member.

16. The sole structure of claim 12, wherein the second barrier member covers the first compartment to define a first interior void and covers the second compartment to define a second interior void, the first quantity of particulate matter being disposed within the first interior void and the second quantity of particulate matter being disposed within the second interior void.

* * * * *